United States Patent [19]

Hopmann

[11] Patent Number: 4,923,012

[45] Date of Patent: May 8, 1990

[54] SAFETY VALVE FOR HORIZONTAL COMPLETIONS OF SUBTERRANEAN WELLS

[75] Inventor: Mark E. Hopmann, Broken Arrow, Okla.

[73] Assignee: Baker Hughes Incorporated, Houston, Tex.

[21] Appl. No.: 308,872

[22] Filed: Feb. 9, 1989

[51] Int. Cl.[5] ..... F21B 34/06

[52] U.S. Cl. ..... 166/385; 166/325; 166/386

[58] Field of Search ..... 166/50, 321, 325, 374, 166/385, 386

[56] References Cited

U.S. PATENT DOCUMENTS

| | | | |
|---|---|---|---|
| 3,071,151 | 1/1963 | Sizer | 137/496 |
| 3,249,124 | 5/1966 | Berryman | 166/331 |
| 4,685,516 | 8/1987 | Smith et al. | 166/385 X |
| 4,729,429 | 3/1988 | Wittrisch | 166/385 X |

*Primary Examiner*—William P. Neuder

*Attorney, Agent, or Firm*—Hubbard, Thurman, Turner & Tucker

[57] ABSTRACT

An apparatus and method are provided relating to a safety valve for horizontal completions of subterranean wells. The apparatus is secured onto one end of a continuous length of remedial tubing which is introduceable into the well and concentrically insertable through production tubing which previously has been positioned within the well with the well having a deviated configuration including an entry portion communicating with a curved portion extending downwardly in the well from the entry portion and a generally linear end portion traversable with a production formation. The apparatus comprises a cylindrical housing and means at one end of the housing for securement of the apparatus to remedial tubing. Fluid throttling means are carried within the housing for abatement of velocity of primary fluid flow from the top of the well through the remedial tubing and the housing. Actuating sleeve means are responsive to fluid flow velocity abatement by the throttling means and are movable in a first direction to position a valve head in open position when in the generally linear end portion of the well to permit fluid to flow through the remedial tubing and the apparatus to the production formation in the generally linear end portion of the well, and movable in a second direction to position the valve head in closed position to prevent passage of fluid from the production formation of the generally linear end portion of the well through the apparatus and the remedial tubing to the top of the well. A valve means includes valve head and seat members which are carried by the housing. In a preferred form, the valve head is movable by the sleeve means to the open position and has a primary fluid flow facing surface which is covered by the sleeve when in the open position.

10 Claims, 2 Drawing Sheets

SAFETY VALVE FOR HORIZONTAL COMPLETIONS OF SUBTERRANEAN WELLS

BACKGROUND OF THE INVENTION

1. FIELD OF THE INVENTION:

The invention relates to a safety valve system for the completion of a horizontal section of a deviated subterranean well.

2. DESCRIPTION OF THE PRIOR ART:

In the past, those skilled in the art relating to remedial operations associated with the drilling, production and completion of subterranean oil and gas wells have relied on conventional "snubbing" or hydraulic workover units which utilize threaded or coupled remedial tubing normally inserted through production tubing for use in operations, such as perforating, acidizing and fracturing, corrosion control, pressure testing of tubular goods and vessels, cementing, clean out operations, sand bridge removal, storm valve recovery, insertion of kill strings, wireline fishing tools, and the like.

Continuous coiled remedial tubing and injectors for use therewith have contributed substantially to conventional remedial tubing operations. For example, coiled tubing, being continuous, can be inserted into the well faster than threaded and coupled tubing which is furnished in relatively short sections that must be screwed together. In addition, it is easier, when required, to pass continuous tubing through stuffing boxes and blowout preventers because its external diameter is consistently the same size and not interrupted periodically by couplings. The coiled remedial tubing normally is made of steel and is commercially available in sizes from 0.75 inch o.d. through 1.315 inch o.d., but may have a smaller or larger diameter.

Typical of such remedial coiled tubing and injectors is that generally described in U.S. Pat. No. 3,182,877. The apparatus is commercially referred to as the "Bowen Continuous Spring Tubing Injector Unit" and basically comprises a hydraulically powered injector unit which feeds a continuous remedial tubing string from a coiled or "spooled" workstring contained on a powered and generally portable reel unit into the wellhead by means of two opposed, endless, rotating traction members. Such a reel unit is generally described in U.S. Pat. No. 3,614,019. The upper end of the string which remains on the reel is conventionally connected to the hollow shaft of the reel which permits a liquid or a gas to be pumped through the coiled remedial tubing string by means of a swivel connection. The injector and reel are normally mounted on a single transportable skid, a trailer, or, alternatively, may be componently arranged on skids to facilitate convenient offshore use.

To inject remedial coiled tubing, the injector is arranged on or above the wellhead. The reel unit, containing up to approximately 15,000 feet of continuous coiled metal remedial tubing, is located preferably about 15 to 20 feet from the wellhead. The remedial coiled tubing is brought from the reel in a smooth arc loop through the injector unit and into the well through pressure retention and control equipment.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation. Most production formations have a substantial horizontal portion and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be redrilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range of 10° to 30° per 100 feet of length.

In such deviated wellbores, particularly those having the longer lengths, it is difficult, if not impossible, to activate completion equipment, such as shifting tools for opening and closing sleeves, activating wash tools, and the like, by means of conventional electric or piano wireline means, which are disposed through the production tubing which, in turn, has been implaced within the well section through casing (assuming that the well is encased), or, alternatively, through open hole (if the well is not so encased).

As the well section becomes more deviated, the weight suspended from the wireline will become insufficient to actuate the tool, or, at least, to properly position it at the desired location within the deviated portion of the well. Such tools can thus be expected to become improperly lodged or unpositionable within such well. Accordingly, remedial continuous coiled tubing can be utilized to perform operations in such wells heretofore practiced by application of wireline actuated devices.

Since remedial continuous tubing must be introduced into the well through the casing and, in most instances, through production tubing, such remedial tubing, if not otherwise restricted, will serve as a conduit through which production fluids will flow to the top of the well in an uncontrolled state during a blowout of the well. Blowout preventer stacks at the top of the well serve to control the well in the annular area between the production tubing and the casing and the interior of the production tubing at all time during the completion operation. In addition, safety valves are carried on the production tubing or implaced therein by wireline to prevent uncontrolled fluid flow from the production zone to the top of the well through such conduit.

When continous coiled tubing is introduced into the production tubing, or the casing through the snubbing unit at the top of the well, it will be desirable for such tubing to carry safety valve means thereon which will permit fluid flow from the top of the well through the coiled tubing and the apparatus for remedial work in the production zone of the well, and for other known applications. However, as contemplated herein, such safety valve must also have the ability to be manipulatable between open and closed positions with integrity during the completion of the horizontal section of the well. Valves which require longitudinal or rotational manipulation of the remedial tubing cannot be utilized with complete confidence because the tubing manipulation is, of course, highly restricted in deviated wells of such configuration as contemplated herein. Additionally, hydraulically activatable safety systems using auxiliary hydraulic conduits extending exteriorly of the main control conduit cannot be tolerated in such horizontal systems.

The present invention is directed to overcoming such deficiencies by providing a method and apparatus for completing horizontal sections of subterranean wells, as described herein, by incorporation of a safety valve system in combination with remedial continuous coiled tubing which is introduceable through production tubing. In a preferred embodiment, the apparatus of the present invention incorporates a sleeve means which covers the sealing surface of the valve head which, preferably, is a flapper valve, when such valve is in the open position, to prevent contaminants and solid particulate matter in well fluids and in the remedial treating fluids, from coming into direct abrasive contact with such valve head, to reduce exposure of such valve head to corrosive and errosive materials, thus reducing the likelihood of a valve failure and thereby extending the life of the apparatus.

DESCRIPTION OF THE PREFERRED EMBODIMENTS

Figure 1:
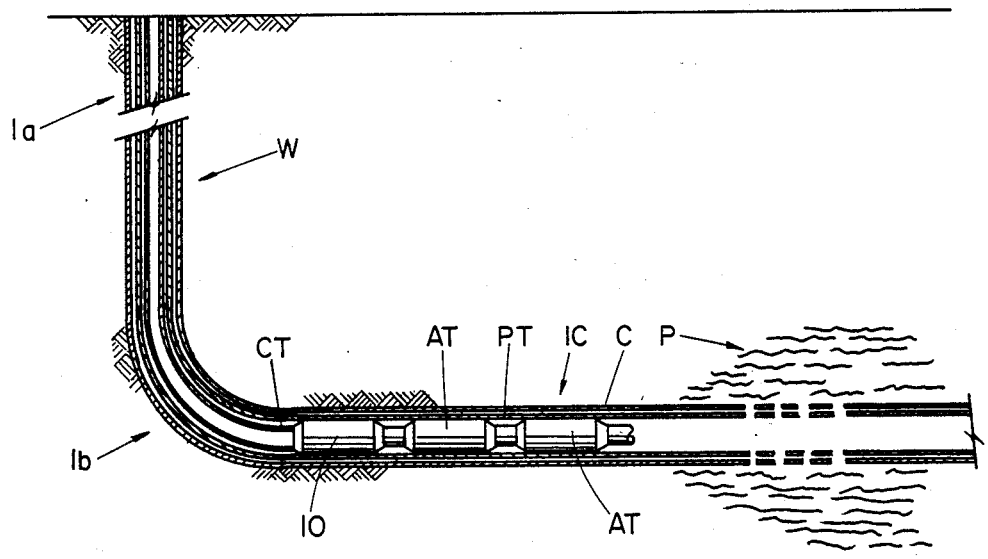
FIG. 1 is a schematic illustration of a deviated portion of a subterranean well, with casing, production tubing and remedial continuous coiled tubing inserted therethrough carrying the valving means of the present invention.
Figure 4:
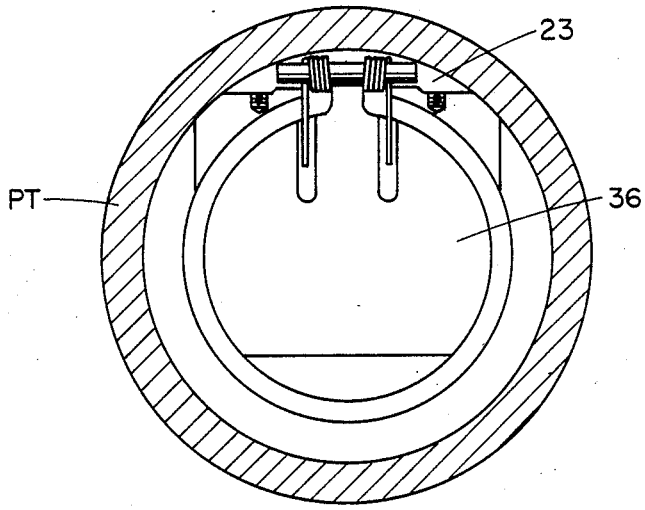
FIG. 4 is a cross-sectional view taken along lines 4—4 of FIG. 2.

Referring now to FIG. 1, there is shown a deviated wellbore W. Such wellbore comprises a vertical entry section 1*a* communicating through a relatively short radius curvature portion 1*b* with a non-vertical or horizontal portion 1*c* communicating with a production formation P.

The wellbore W is shown encased by casing C through which is positioned production tubing PT which, in turn, has inserted therethrough a continuous length of remedial coiled tubing CT which carries a plurality of auxiliary tools AT at the end thereof. The auxiliary tools AT may be any one of a number of known components, such as a shifting tool for manipulating a sliding sleeve carried on the production tubing PT between open and closed positions, or the like. The apparatus 10 of the present invention is shown on the coiled tubing CT immediately before the auxiliary tool AT.

Figure 2:
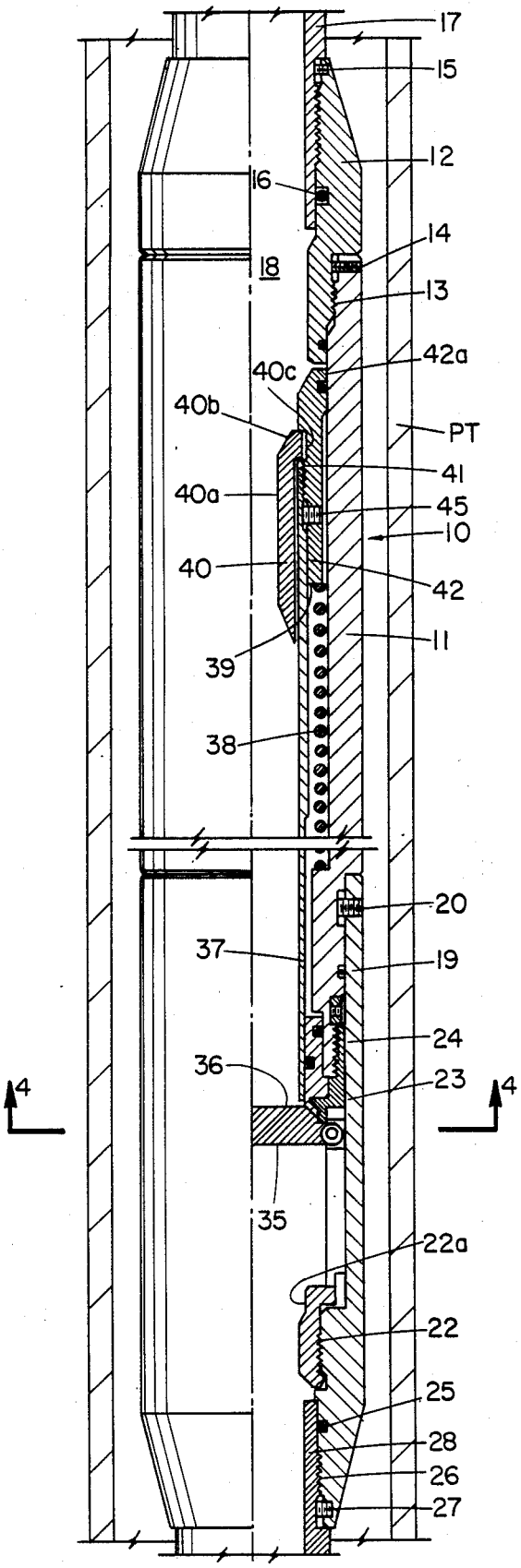
FIG. 2 is a longitudinal sectional view of the apparatus of the present invention within the well deviated portion and within a generally linear end portion traversable through the production formation, with the valving means being in the closed position.

Now referring to FIG. 2, showing the apparatus 10 in the closed position, the apparatus 10 has a longitudinally extending cylindrical housing member 11 which is secured to a companion upper housing section 12 by means of threads 13 with a set screw 14 disposed within the uppermost end of the central housing 11 for additional securement relative to the upper housing section 12. A similar set screw 15 is implaced within the uppermost portion of the upper housing section 12 for securement of the housing section 12 relative to the connector 17 extending thereabove into securement to an attaching tool (not shown) which, in turn, is affixed to the lowermost end of the coiled tubing CT.

A circumferentially extending elastomeric O-ring seal element 16 is housed within its bore in the upper housing section 12 to prevent fluid communication between the upper housing section 12 and the connector 17.

Interiorly of the connector 17 and the apparatus 10 is a primary fluid flow passageway 18 to permit fluid communication between the coiled tubing CT thereabove and the interior of the apparatus and its associated tool AT therebelow and for ultimate communication within the non-vertical or horizontal section 1*c* of the well W communicating with the production formation P.

The central housing 11 is secured at its lowermost end by means of a set screw 20 to a cylindrical valve housing 19 which, in turn, is secured to a lowermost connector 28 by means of threads 26. The connector 28 extends from the apparatus 10 to the auxiliary tool AT therebelow. A set screw 27 also secures the connector 28 to the valve housing 19, with an O-ring element 25 disposed within a groove circumferentially extending around the internal diameter of the valve housing 19 to prevent fluid communication between the housing 19 and the connector 28.

Interiorly of the valve housing 19 is a flapper housing 23 for receipt of the valve head member 35 when it is shifted to its open position, as discussed below. The flapper housing 23 is secured by means of threads 22 to the valve housing 19 at its lowermost end and is also secured to the central housing 11 at its uppermost end by means of threads 24. The flapper housing 23 has a receiving surface 22*a* for receipt of the lowermost end 37*a* of the control mandrel 37 as the apparatus 10 is manipulated to move the valve head 35 to the open position, as described below, thereby permitting the mandrel 37 to completely cover the primary fluid facing face 36 to prevent direct fluid contact therewith to abate corrosion and errosion effects thereon.

The valve head 35 is secured to the flapper housing 23 by means of a flapper pin 34, with the flapper head 35 being spring biased to the closed position by a spring carried immediate the pin 34. The face 36 of the valve head 35 contains an outwardly curved portion 36-*a* for sealing mating engagement with a metallic seal face 32 disposed circumferentially around the lowermost end of the flapper seat 29. An elastomeric seal 30 prevents fluid communication between the flapper seat 29 and the central housing 11, and a similar elastomer 31 acts as a debris barrier between the flapper seat 29 and the control mandrel 37 interposed interiorly thereof and longitudinally manipulatable relative thereto.

The central housing also provides elastomeric O-ring seal element 21 carried exteriorly therearound to prevent fluid communication between the central housing 11 and the valve housing 19.

The fluid throttling means of the present invention includes a longitudinally extending throttle housing 40 having a smooth interior housing passageway 40*a* therethrough of reduced diameter than the diameter of the connector 17 thereabove and the upper housing section 12 below the connector 17 to cause effective throttling of the primary fluid flow through the remedial tubing and the uppermost end of the apparatus 10. The throttle housing 40 also provides an upper flow conical configuration 40*b* at its uppermost end for initiating throttling of the primary fluid through the fluid throttling means. The throttle housing 40 thus acts as an orifice, with the housing 40 being positioned within a groove 40*c* on a spring retainer 42 which is secured by threads 41 and set screw 45 to the mandrel 37 carried interiorly thereof, the retainer 42 being slidingly manipulatable longitudinally around the smooth interior of the central housing 11 during manipulation of the valving means between open and closed positions.

The spring retainer 42 has an uppermost face 42*a* which "no-goes" in the uppermost direction with a lower companion face 12*a* on the upper housing section 12 to define the uppermost limits of longitudinal travel during valve manipulation to the closed position.

A dynamic elastomeric wiper 43 is carried around the exterior uppermost end of the spring retainer 42 to prevent fluid communication between the retainer 42 and the interior of the central housing 11, with a static O-ring 44 carried on the upper housing section 12 to prevent fluid communication between the section 12 and the central housing 11. The spring retainer 42 has its lower face 39 in abutment with the uppermost end of a biasing spring element 38 housed interiorly of the central housing 11 and exteriorly of the control mandrel 37, the control mandrel 37 being secured around the exterior of the throttle housing 40 by means of the threads 41 to the spring retainer 42.

OPERATION

In completion of the deviated well W, the apparatus 10 is secured to the coiled tubing CT at the top of the well W prior to introduction of the coiled tubing CT into the well W through the production tubing PT which previously has been introduced and implaced within the well W through the casing C and across the production formation P. Thereafter, the coiled tubing CT with the apparatus 10 thereon is introduced through the snubbing unit (not shown) at the top of the well W and through the production tubing PT. In such condition, the apparatus 10 is in its closed position with the valve head 35 on the seat 32 and the spring 38 driving the throttle housing 40 and the spring retainer 42 to interengagement of the shoulders 42*a*, 12*a*.

Figure 3:
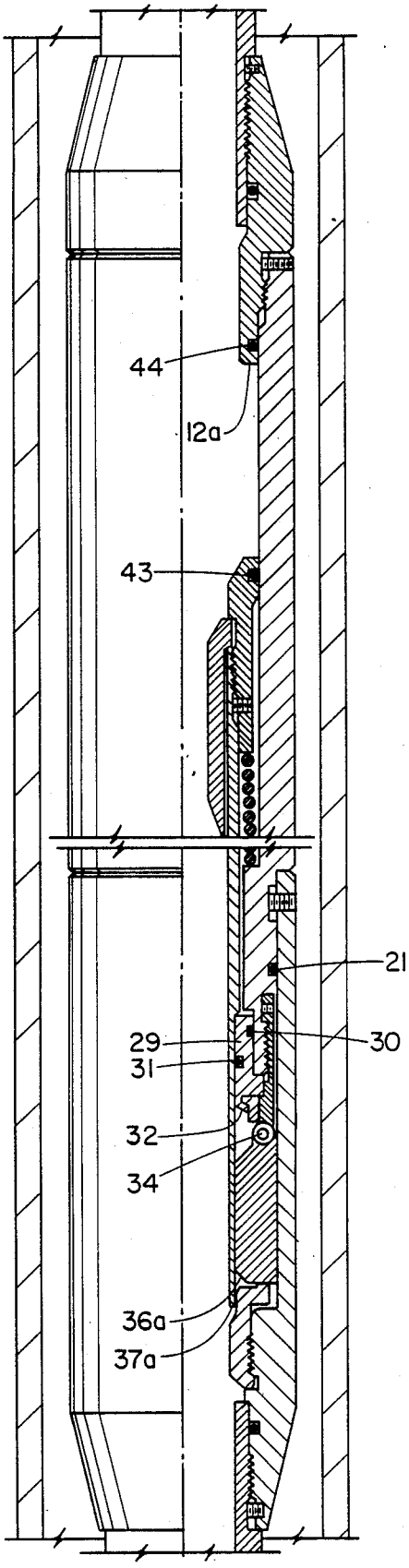
FIG. 3 is a view similar to that of FIG. 2 showing primary fluid flow activating the throttling means to urge the actuating sleeve means into valve opening position.

To manipulate the apparatus 10 from the position shown in FIG. 2 to the open position shown in FIG. 3, primary fluid, such as a corrosion inhibitor, or the like, is introduced through the coiled tubing CT at the top of the well W and through the passageway 18. As such fluid passes the upper flow restrictor 40*b* on the throttle housing 40, the velocity of such fluid will be throttled and such throttling will be transferred to the control mandrel 37 when such throttling overcomes the biasing of the spring 38 in the upper position. Continued throttling caused by the primary fluid flow through the upper flow restrictor 40*b* and through the throttle housing 40 will compress the spring 38 and move the control mandrel 37, the throttle housing 40, and the spring retainer 42 downwardly, such that the lower end 37*a* of the control mandrel 37 will contact the upper face 36 of the flapper valve head member 35 to contact and engage same and move the valve head 35 into the flapper housing 23.

Continued throttling of the fluid will move the control mandrel 37 downwardly until the lower end 37*a* of the control mandrel 37 abuts the receiving surface 22*a* of the flapper housing 23, whereby the flapper head 35 and its face 36 are completely directly protected from particulate contaminants within the fluid passing through the passageway 18, either as the primary fluid is introduced from the top of the well W through the coiled tubing CT, or, alternatively, with the production fluid in the well W, or any other fluid within the well W passing in either direction. Now, the apparatus 10 is in the position shown as in FIG. 3.

The apparatus 10 may be manipulated from the position shown in FIG. 3 to the initial position shown in FIG. 2 by reduction of the rate of flow of the primary fluid through the passageway 18 within the interior of the coiled tubing CT. In such event, the throttling through the upper flow restrictor 40*b* of the throttle housing 40 will be reduced, such that the biasing within the spring 38 will overcome such throttling and the control mandrel 37 will be urged upwardly until the faces 42*a*, 12*a* interface and the lower end 37*a* of the control mandrel 37 is moved completely away from the upper face 36 of the flapper head 35. The spring carried interior of the pin 34 will permit the flapper head 35 to be biased toward the closed position and maintained thereon such that the face 36 now becomes sealingly engaged with the sealing metallic element 32.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for securement onto one end of a continuous length of remedial tubing introduceable into a subterranen well and concentrically insertable through production tubing previously positioned within said well, said well having a deviated configuration including an entry portion communicating with a curved portion extending downwardly in the well from said entry portion, and a generally linear end portion traversable with a production formation, said apparatus comprising:

(1) a cylindrical housing;

(2) means at one end of said housing for securement to said one end of said remedial tubing;

(3) a fluid throttling sleeve carried within said housing and having a first internal diameter for abatement of velocity of primary fluid flow from the top of said well, through said remedial tubing and said housing;

(4) a control mandrel responsive to fluid flow velocity abatement by said fluid throttling sleeve having a second internal diameter larger than the internal diameter of said fluid throttling sleeve and movable in a first direction to position a valve head in open position when in said generally linear end portion of said well to permit primary fluid to flow through said remedial tubing and said apparatus to the production formation in the generally linear end portion of said well, and movable in a second direction to position said valve head in closed position to prevent passage of fluid from said production formation within said generally linear end portion of said well through said apparatus and said remedial tubing to the top of said well; and (5) valve means including valve head and seat members carried by said housing.

2. The apparatus of claim 1, said valve head being movable by said sleeve means to the open position and having a primary fluid flow facing surface covered by said sleeve when in the open position.

3. A method of completing a generally linear end portion of a subterranen well traversable with a production formation, said well having a deviated configuration including an entry portion communicating with a curved portion extending downwardly in the well from said entry portion, said curved portion extending to said generally linear end portion, comprising the steps of:

(1) affixing at the surface of the well onto one end of a continuous length of remedial tubing introduceable into said well through production tubing, said production tubing extending through said generally linear end portion of said well to said production formation, an apparatus comprising:

(a) a cylindrical housing;

(b) means at one end of said housing for securement to said one end of said remedial tubing;

(c) a fluid throttling sleeve carried within said housing and having a first internal diameter for abatement of velocity of primary fluid flow from the top of said well, through said remedial tubing and said housing;

(d) a control mandrel responsive to fluid flow velocity abatement by said fluid throttling sleeve having a second internal diameter larger than the internal diameter of said fluid throttling sleeve and movable in a first direction to position a valve head in open position when in said generally linear end portion of said well to permit fluid to flow through said remedial tubing and said apparatus to the production formation in the generally linear end portion of said well, and movable in a second direction to position said valve head in closed position to prevent passage of fluid from said production formation of said generally linear end portion of said well through said apparatus and said remedial tubing to the top of said well; and (e) valve means including valve head and seat members carried by said housing;

(2) introducing said remedial tubing and said apparatus secured thereon into said well through said production tubing and previously positioned within said well through said deviated configuration to said generally linear end portion traversable with said production tubing; and (3) activating said throttling means to manipulate said actuating sleeve means in said first direction to position said valve head in open position by introducing a pressured primary fluid through said remedial tubing at the top of the well and through said apparatus.

4. The method of claim 3 further comprising the step of: decreasing the rate of primary fluid flow through said remedial tubing and said apparatus whereby said throttling means does not abate fluid flow velocity sufficient to permit said actuating sleeve means to retain said valve head member in open position.

5. A method of completing a generally linear end portion of a subterranen well traversable with a production formation, said well having a deviated configuration including an entry portion communicating with a curved portion extending downwardly in the well from said entry portion, said curved portion extending to said generally linear end portion, comprising the steps of:

(1) affixing at the surface of the well onto one end of a continuous length of remedial tubing introduceable into said well through production tubing previously positioned within said well, said production tubing extending through said generally linear end portion of said well to said production formation, an apparatus comprising:

(a) a cylindrical housing;

(b) means at one end of said housing for securement to said one end of said remedial tubing;

(c) a fluid throttling sleeve carried within said housing and having a first internal diameter for abatement of velocity of primary fluid flow from the top of said well, through said remedial tubing and said housing;

(d) a control mandrel responsive to fluid flow velocity abatement by said fluid throttling sleeve having a second internal diameter larger than the internal diameter of said fluid throttling sleeve and movable in a first direction to position a valve head in open position when in said generally linear end portion of said well to permit fluid to flow through said remedial tubing and said apparatus to the production formation in the generally linear end portion of said well, and movable in a second direction to position said valve head in closed position to prevent passage of fluid from said production formation of said generally linear end portion of said well through said apparatus and said remedial tubing to the top of said well, said valve head being movable by said sleeve means to the open position and having a primary fluid flow facing surface covered by said sleeve when in the open position; and (e) valve means including valve head and seat members carried by said housing;

(2) introducing said tubing and said apparatus secured thereon into said well through said deviated configuration to said generally linear end portion traversable with said production tubing; and (3) activating said throttling means to manipulate said actuating sleeve means in said first direction to position said valve head in open position by introducing a pressured fluid through said remedial tubing at the top of the well, and through said apparatus.

6. The method of claim 5 further comprising the step of: decreasing the rate of primary fluid flow through said remedial tubing and said apparatus whereby said throttling means does not abate fluid flow velocity sufficient to permit said actuating sleeve means to retain said valve head member in open position.

7. A method of completing a generally linear end portion of a subterranen well traversable with a production formation, said well having a deviated configuration including an entry portion communicating with a curved portion extending downwardly in the well from said entry portion, said curved portion extending to said generally linear end portion, comprising the steps of:

(1) affixing at the surface of the well onto one end of a continuous length of remedial tubing introduceable into said well through production tubing previously positioned within said well, said production tubing extending through said generally linear end portion of said well to said production formation, an apparatus comprising:

(a) a cylindrical housing;

(b) means at one end of said housing for securement to said one end of said remedial tubing;

(c) a fluid throttling sleeve carried within said housing and having a first internal diameter for abatement of velocity of primary fluid flow from the top of said well, through said remedial tubing and said housing;

(d) a control mandrel responsive to fluid flow velocity abatement by said fluid throttling sleeve having a second internal diameter larger than the internal diameter of said fluid throttling sleeve and movable in a first direction to position a valve head in open position when in said generally linear end portion of said well to permit primary fluid to flow through said remedial tubing and said apparatus to the production formation in the generally linear end portion of said well, and movable in a second direction to position said valve head in closed position to prevent passage of fluid from said production formation of said generally linear end portion of said well through said apparatus and said remedial tubing to the top of said well, said valve head being movable by said sleeve means to the open position and having a primary fluid flow facing surface covered by said sleeve when in the open position; and (e) valve means including valve head and seat members carried by said housing;

(2) introducing said remedial tubing and said apparatus secured thereon into said well through said deviated configuration to said generally linear end portion traversable with said production tubing;

(3) activating said throttling means to manipulate said actuating sleeve means in said first direction to position said valve head in open position by introducing a pressured primary fluid through said remedial tubing at the top of the well, through said deviated configuration and through said apparatus; and (4) continuing introduction of said pressurized fluid through said remedial tubing and said apparatus to drive said sleeve means and position said sleeve means across the primary fluid flow facing surface of said valve head member.

8. The method of claims 3, 5 and 7 further comprising the step of: decreasing the rate of primary fluid flow through said remedial tubing and said apparatus whereby said throttling means does not abate fluid flow velocity sufficient to permit said actuating sleeve means to retain said valve head member in open position.

9. The apparatus of claims 1, 2 or 3 further comprising biasing means for urging said sleeve means in a second direction when overcoming primary fluid flow abatement through said fluid throttling means to move said valve head member to closed position.

10. The method of claims 3, 5 and 7 further comprising the step of: manipulating said valve head member to closed position relative to said valve seat member by biasing means initially compressed by movement of said fluid throttling means when said valve head is manipulated to said open position, whereby when said valve head member is sealingly engaged upon said valve seat member thereafter, fluid within said production formation adjacent said linear end portion of said well is prevented from entering said apparatus above said valve means and into said remedial tubing.

* * * * *